US008595017B2

(12) United States Patent
Delattre

(10) Patent No.: US 8,595,017 B2
(45) Date of Patent: Nov. 26, 2013

(54) AUDIO ENCODING METHOD AND DEVICE

(75) Inventor: Alexandre Delattre, Viroflay (FR)

(73) Assignee: Mobiclip, Paris (FR)

( * ) Notice: Subject to any disclaimer, the term of this patent is extended or adjusted under 35 U.S.C. 154(b) by 1041 days.

(21) Appl. No.: 12/521,070

(22) PCT Filed: Dec. 27, 2007

(86) PCT No.: PCT/EP2007/011433
§ 371 (c)(1),
(2), (4) Date: Nov. 12, 2009

(87) PCT Pub. No.: WO2008/080605
PCT Pub. Date: Jul. 10, 2008

(65) Prior Publication Data

US 2010/0094640 A1 Apr. 15, 2010

(30) Foreign Application Priority Data

Dec. 28, 2006 (FR) ..... 06 11481

(51) Int. Cl.
*G10L 19/00* (2013.01)

(52) U.S. Cl.
USPC ..... 704/500; 381/16; 381/17; 381/19; 381/20; 381/21; 381/22; 381/23; 704/205; 704/207; 704/219; 704/221; 704/229; 704/233

(58) Field of Classification Search
USPC ..... 381/16, 17, 19–23; 704/205, 207, 219, 704/221, 229, 233
See application file for complete search history.

(56) References Cited

U.S. PATENT DOCUMENTS

| | | | | |
|---|---|---|---|---|
| 4,757,517 | A | 7/1988 | Yatsuzuka | |
| 5,070,515 | A * | 12/1991 | Iwahashi et al. | 375/245 |
| 5,974,380 | A | 10/1999 | Smyth et al. | |
| 5,995,493 | A * | 11/1999 | Van de Kerkhof | 370/286 |
| 6,226,616 | B1 * | 5/2001 | You et al. | 704/500 |
| 6,674,862 | B1 | 1/2004 | Magilen | |
| 7,224,747 | B2 * | 5/2007 | Rijnberg et al. | 375/296 |
| 7,437,299 | B2 * | 10/2008 | Aarts et al. | 704/500 |
| 7,516,066 | B2 * | 4/2009 | Schuijers et al. | 704/219 |

(Continued)

FOREIGN PATENT DOCUMENTS

| | | |
|---|---|---|
| DE | 10 2005 000 830 | 7/2006 |
| WO | WO 02/41301 | 5/2002 |
| WO | 2004/093494 A1 | 10/2004 |

OTHER PUBLICATIONS

James caron, Blind Deconvolution of audio-frequency signals using the self-deconvolving data restoration algorithm, 2004.*

(Continued)

*Primary Examiner* — Mohammad Islam
*Assistant Examiner* — Kuassi Ganmavo
(74) *Attorney, Agent, or Firm* — Nixon & Vanderhye, P.C.

(57) ABSTRACT

Audio encoding method and device comprising the transmission, in addition to the data representing a frequency-limited signal, of information relating to a temporal filter that can be applied to the entire broadened signal, both in its transmitted low-frequency part and in its reconstituted high-frequency part. The application of this filter allowing the reshaping the reconstituted high-frequency part and the correction of compression artifacts present in the transmitted low-frequency part. In this way, the application of the temporal filter, simple and inexpensive, to all or part of the reconstituted signal, makes it possible to obtain a signal of good perceived quality.

10 Claims, 2 Drawing Sheets

(56) References Cited

U.S. PATENT DOCUMENTS

| | | | | |
|---|---|---|---|---|
| 7,573,912 | B2 | 8/2009 | Lindblom | |
| 7,711,123 | B2 * | 5/2010 | Crockett | 381/56 |
| 7,725,324 | B2 | 5/2010 | Bruhn et al. | |
| 7,840,401 | B2 | 11/2010 | Pang et al. | |
| 7,945,447 | B2 | 5/2011 | Yoshida et al. | |
| 7,979,271 | B2 | 7/2011 | Bessette | |
| 8,019,087 | B2 | 9/2011 | Goto et al. | |
| 2003/0158726 | A1 | 8/2003 | Philippe et al. | |
| 2005/0246164 | A1 | 11/2005 | Ojala et al. | |
| 2006/0235678 | A1 | 10/2006 | Kim et al. | |
| 2007/0236858 | A1 | 10/2007 | Disch et al. | |
| 2010/0046760 | A1 | 2/2010 | Delattre | |

OTHER PUBLICATIONS

Prandoni et al, An FIR Cascade Structure for adaptive linear prediction, IEEE, Sep. 1998.*

International Preliminary Report on Patentability for PCT/EP2007/011433, mailed Sep. 28, 2009.

International Search Report for PCT/EP2007/011433, mailed Mar. 25, 2008.

Foreign-language Written Opinion of the International Searching Authority for PCT/EP2007/011433, mailed Mar. 25, 2008.

Ziegler T. et al., "Enhancing MP3 with SBR: Features and Capabilities of the New MP3PRO Algorithm", Audio Engineering Society Convention Paper, vol. 112, No. 5560, (May 10, 2002), pp. 1-7.

Dietz, M. et al., "Spectral Band Replication, A Novel Approach in Audio Coding", Audio Engineering Society Convention Paper, vol. 112, No. 5553, (May 10, 2002), pp. 1-8.

Michael Goodwin et al., "Frequency-Domain Algorithms for Audio Signal Enhancement Based on Transient Modification", J. Audio Eng. Soc., vol. 54, No. 9, Sep. 2006, pp. 827-840 (14 pages total).

Carlos Avendano, "Temporal Processing of Speech in a Time-Feature Space", Thesis, Oregon Graduate Institute of Science & Technology, Apr. 1997, (130 pages total).

Notice of Allowance mailed Oct. 18, 2012 in U.S. Appl. No. 12/521,076 (10 pages).

Office Action mailed Mar. 2, 2012 in U.S. Appl. No. 12/521,076 (17 pages).

Preliminary Examination Report on Patentability dated Oct. 6, 2009 in Application No. PCT/EP2007/011442 (11 pages).

International Search Report and Written Opinion dated Mar. 7, 2008 in Application No. PCT/EP2007/011442 (14 pages).

* cited by examiner

AUDIO ENCODING METHOD AND DEVICE

This application is the U.S. national phase of International Application No. PCT/EP2007/011433, filed 27 Dec. 2007, which designated the U.S. and claims priority to France Application No. 06/11481 filed 28 Dec. 2006, the entire contents of each of which are hereby incorporated by reference.

TECHNICAL FIELD OF THE INVENTION

The present invention concerns an audio encoding method and device. It applies in particular to the encoding with enhancement of all or part of the audio spectrum, in particular with a view to transmission thereof over a computer network, for example the Internet, or storage thereof on a digital information medium. This method and device can be integrated in any system for compressing and then decompressing an audio signal on all hardware platforms.

BACKGROUND OF THE INVENTION

In audio compressions, the rate is often reduced by limiting the bandwidth of the audio signal. Generally, only the low frequencies are kept since the human ear has better spectral resolution and sensitivity at low frequency than at high frequency. Typically, only the low frequencies of the signal are kept, and thus the rate of the data to be transferred is all the lower. As the harmonics contained in the low frequencies are also present in the high frequencies, some methods of the prior art attempt, from the signal limited to low frequencies, to extract harmonics that make it possible to recreate the high frequencies artificially.

These methods are generally based on a spectral enhancement consisting of recreating a high-frequency spectrum by transposition of the low-frequency spectrum, this high-frequency spectrum being reshaped spectrally. The resulting signal is therefore composed, for the low-frequency part, of the low-frequency signal received and, for the high-frequency part, the reshaped enhancement.

It turns out that the compression and method used for compressing and limiting the bandwidth of the initial frequency generate artefacts impairing the quality of the signal. Moreover, the reconstitution of a quality signal in reception must make it possible to obtain the best possible perceived quality while requiring only a small transmitted data bandwidth and simple and rapid processing on reception.

SUMMARY OF THE INVENTION

This problem is advantageously resolved by the transmission, in addition to the data representing the frequency-limited signal, of information relating to a temporal filter that is to be applied to the whole of the broadened signal, both in its transmitted low-frequency part and in its reconstituted high-frequency part. The application of this filter allowing the reshaping of the reconstituted high-frequency part and the correction of compression artefacts present in the transmitted low-frequency part. In this way, the application of the temporal filter, which is simple and inexpensive, to the whole of the reconstituted signal makes it possible to obtain a good-quality perceived signal.

The invention concerns a method of encoding a signal comprising at least the following steps:

- a step of obtaining a frequency-limited signal, the reduction of the spectrum of the original signal being obtained by suppression of the high frequencies,

- a step of generating a temporal filter for finding a signal spectrally close to the original signal when it is applied to the signal obtained by broadening the spectrum of the limited signal.

According to a particular embodiment of the invention, for a given portion of the original signal, the filter is obtained by member to member division of a function of the coefficients of a Fourier transform applied to the portion of the original signal and to the corresponding portion of the signal obtained by broadening of the spectrum of the limited signal.

According to a particular embodiment of the invention, Fourier transforms of different sizes are used for obtaining a plurality of filters corresponding to each size used. The generated filter corresponding to a choice from the plurality of filters obtained by comparison of the original signal, and the signal obtained by application of the filter to the signal obtained by broadening of the spectrum of the limited signal.

According to a particular embodiment of the invention, the choice is extended to a collection of predetermined temporal filters.

According to a particular embodiment of the invention, the frequency-limited composite signal being encoded with a view to transmission thereof, the filter is generated using the signal obtained by decoding and broadening of the spectrum of the encoded limited composite signal and the original signal.

The invention also concerns a method of decoding a signal comprising at least the following steps:

- a step of receiving a transmitted signal,
- a step of receiving a temporal filter relating to the received signal,
- a step of obtaining a decoded signal by decoding the received signal,
- a step of obtaining an extended signal by broadening the spectrum of the decoded signal,
- a step of obtaining a reconstructed signal by convolution of the extended signal with the temporal filter received.

According to a particular embodiment of the invention, a filter reduced in size from the filter generated is used in place of this generated filter in the step of obtaining a reconstructed signal.

According to a particular embodiment of the invention, the choice of using a filter of reduced size in place of the filter generated is made according to the capacities of the decoder.

The invention also concerns a device for encoding a signal comprising at least:

- means of obtaining a frequency-limited signal, the reduction of the spectrum of the original signal being obtained by suppression of the high frequencies,
- means of obtaining an encoded frequency-limited signal by encoding the frequency-limited signal,
- means of generating a temporal filter for finding a signal close to the original signal when it is applied to the signal obtained by decoding and broadening of the spectrum of the limited signal.

The invention also concerns a device for decoding a signal, comprising at least the following means:

- means of receiving a transmitted signal,
- means of receiving a temporal filter relating to the received signal,
- means of obtaining a decoded signal by decoding the received signal,
- means of obtaining an extended signal by broadening the spectrum of the decoded signal,
- means of obtaining a reconstructed signal by convolution of the extended signal with the temporal filter received.

BRIEF DESCRIPTION OF THE DRAWINGS

The features of the invention mentioned above, as well as others, will emerge more clearly from a reading of the following description of an example embodiment, the said description being given in relation to the accompanying drawings, among which.

DETAILED DESCRIPTION OF THE INVENTION

Figure 1:
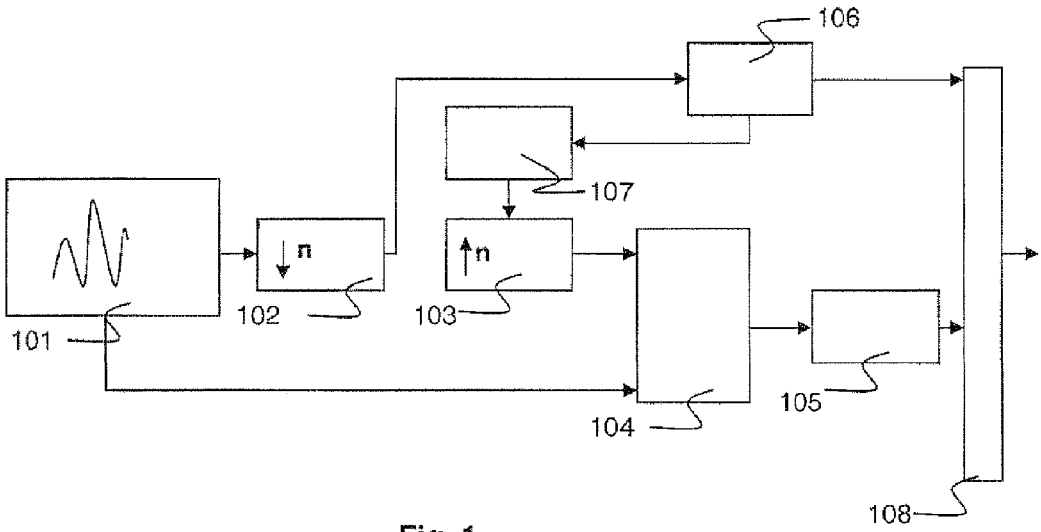
FIG. 1 shows the general architecture of the method of encoding an example embodiment of the invention.

FIG. 1 shows the encoding method in general terms. The signal 101 is the source signal that is to be encoded, and this signal is then the original signal not limited in terms of frequency. Step 102 shows a step of frequency limitation of the signal 101. This frequency limitation can for example be implemented by a subsampling of the signal 101 previously filtered by a low-pass filter. A subsampling consists of keeping only one sample on a set of samples and suppressing the other samples from the signal. A subsampling by a factor of "n" where one sample out of n is kept makes it possible to obtain a signal where the width of the spectrum will be divided by n. n is here a natural integer. It is also possible to effect a subsampling by a rational ratio q/p; supersampling is carried out by a factor p and then subsampling by a factor q. It is preferable to commence with supersampling in order not to lose spectral content. For a change in frequency by a non-rational ratio, it is possible to seek the closest rational fraction and to proceed as above. Other methods of limiting the spectrum of the input signal 101 can also be used as basic filtering methods. The resulting signal, which will be termed the frequency-limited signal, is then encoded during step 106. Any audio encoding or compression means can be used here such as for example an encoding according to the PCM, ADPCM or other standards. This frequency-limited signal will be supplied to the multiplexer 108 with a view to transmission thereof to the decoder.

The frequency-limited signal encoded at the output from the compression module 106 is also supplied as an input to a decoding module 107. This module performs the reverse operation to the encoding module 106 and makes it possible to construct a version of the frequency-limited signal identical to the version to which the decoder will have access when it also performs this operation of decoding the encoded limited signal that it will receive. The limited signal thus decoded is then restored in the original spectral range by a frequency-broadening module 103. This frequency broadening can for example consist of a simple supersampling of the input signal by the insertion of samples of nil value between the samples of the input signal. Any other method of broadening the spectrum of the signal can also be used. This extended frequency signal, issuing from the frequency broadening module 103, is then supplied to a filter generation module 104. This filter generation module 104 also receives the original signal 101 and calculates a temporal filter making it possible, when it is applied to the extended signal issuing from the frequency broadening module 103, to shape it so as to come close to the original signal. The filter thus calculated is then supplied to the multiplexer 108 after an optional compression step 105.

In this way it is possible to transport a frequency-limited and compressed version of the signal to be transmitted and the coefficients of a temporal filter. This temporal filter making it possible, once applied to the decompressed and frequency-extended signal, to reshape the latter in order to find an extended signal close to the original signal. The calculation of the filter being made on the original signal and on the signal as will be obtained by the decoder following the decompression and frequency broadening makes it possible to correct any defects introduced by these two processing phases. Firstly, the filter being applied to the reconstructed signal in its entire frequency range makes it possible to correct certain compression artefacts on the low-frequency part transmitted. Secondly, it also reshapes the high-frequency part, not transmitted, reconstructed by frequency broadening.

Figure 2:
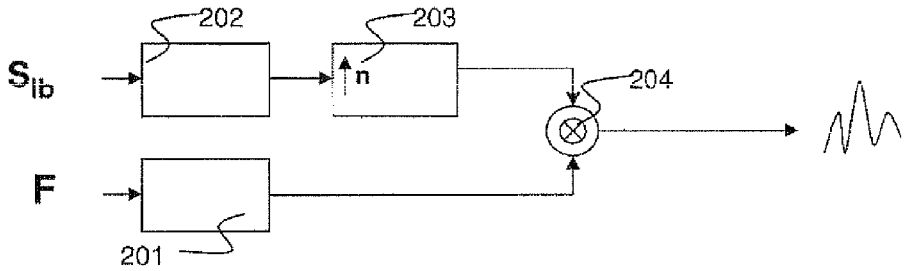
FIG. 2 shows the general architecture of the decoding method of the example embodiment of the invention.

FIG. 2 shows in general terms the corresponding decoding method. The decoder therefore receives the signal issuing from the multiplexer 108 of the coder. It demultiplexes it in order to obtain the encoded frequency-limited signal, called S1*b*, and the coefficients of the filter F, contained in the transmitted signal. The signal S1*b* is then decoded by a decoding and decompression module 202 functionally equivalent to the module 107 in FIG. 1. Once decoded, the signal is extended in frequency by the module 203 equivalent functionally to the module 103 of FIG. 1. A decoded and frequency-extended version of the signal is therefore obtained. In addition, the coefficients of the filter F are decoded if they had been encoded or compressed by a decompression module 201, and the filter obtained is applied to the extended temporal signal in a module for shaping the signal 204. A signal is then obtained as an output close to the original signal. This processing is simple to implement because of the temporal nature of the filter to be applied to the signal for re-shaping.

The filter transmitted, and therefore applied during the reconstruction of the signal, is transmitted periodically and changes over time. This filter is therefore adapted to a portion of the signal to which it applies. It is thus possible to calculate, for each portion of the signal, a temporal filter particularly adapted according to the dynamic spectral characteristics of this signal portion. In particular, it is possible to have several types of temporal filter generator and to select, for each signal portion, the filter giving the best result for this portion. This is possible since the filter generation module possesses firstly the original signal and secondly the extended signal as will be reconstructed by the decoder and it is therefore in a position, where it is generated by several different filters, to compare the signal obtained by application of each filter to the extended signal portion and the original signal to which it is sought to approach as close as possible. This filter generation method is therefore not limited to choosing a given type of filter for the whole of the signal but makes it possible to change the type of filter according to the characteristics of each signal portion.

Figure 3:
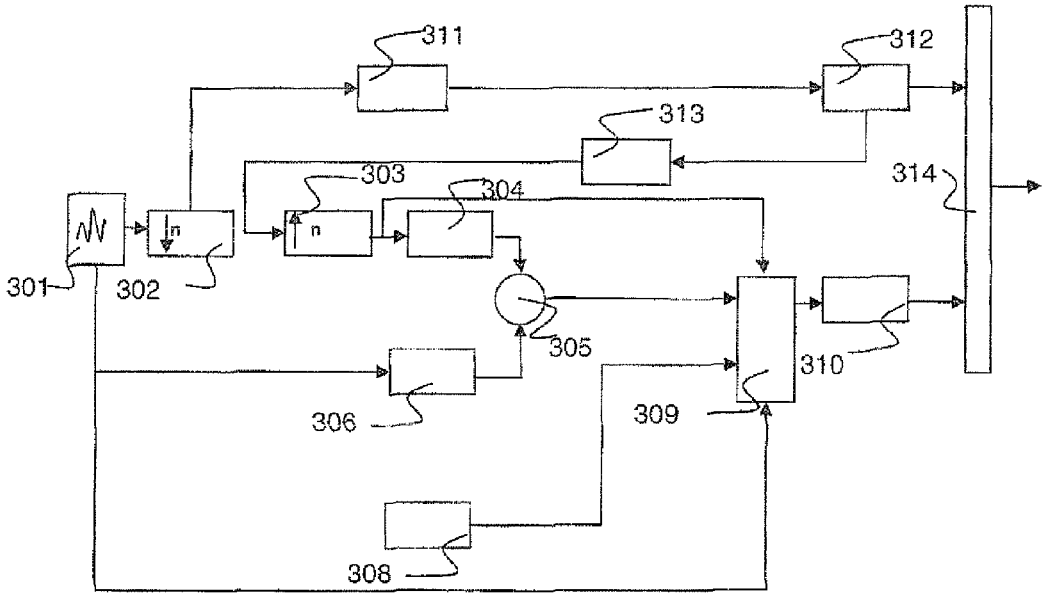
FIG. 3 shows the architecture of an embodiment of the encoder.

A particular embodiment of the invention will now be described in detail with the help of FIGS. 3 and 4. In this embodiment, it is sought, from a signal sampled at a given frequency 301, for example 32 kHz, to obtain the signal limited to its low frequencies, called S1*b*. It is also sought to determine a filter F for shaping the signal obtained by extending in frequency the signal S1*b*. The original signal 301 is filtered by a low-pass filter and subsampled by a factor n by the subsampling module 302. From the original signal only one sample out of n is kept, where n is a natural integer. In practice, n does not generally exceed 4. The signal then loses in terms of spectral range and, for example, for n=2, a signal sampled at 16 kHz is obtained. This signal is then encoded, for example by a method of the PCM ("Pulse Code Modulation") type, by the module 311, which will then be compressed, for example by an ADPCM (the module 302). In this way the subsampled signal is obtained containing the low frequencies of the original signal 301. This signal is sent to the multiplexer 314 in order to be sent to the decoder.

In parallel, this signal is transmitted to a decoding module 313. In this way, in the encoder, the signal that the decoder will obtain from the signal that will be sent to it is simulated. This signal, which will be used for generating the filter F, will therefore make it possible to take account of the artefacts resulting from these coding and decoding, compression and decompression, phases. This signal is then extended in frequency by insertion of n−1 zeros between each sample of the temporal signal in the module 303. In this way a signal with the same spectral range as the original signal is reconstructed. According to the Nyquist theorem, an $n^{th}$ order spectral abasing is obtained. For example, for n=2, the signal is subsampled by a 2nd order on encoding and supersampled by a 2nd order on decoding. The spectrum is "mirror" duplicated by axial symmetry in the frequency domain. In the module 304, a Fourier transform is performed on the frequency-extended temporal frequency issuing from the module 303. In fact, a sliding fast Fourier transform is effected on working windows of given variable size. These sizes are typically 128, 256, 512 samples but may be of any size even if use will preferentially be made of powers of two to simplify the calculations. Next the moduli of these transforms applied to these windows are calculated. The same Fourier transform calculation is performed on the original signal in the module 306.

A member to member division 305 is then performed between the moduli of the coefficients of the Fourier transform obtained by steps 304 and 306 in order to generate, by inverse Fourier transforms, temporal filters of sizes proportional to those of the windows used, and therefore 128, 256 or 512. The greater the size of the window chosen, the more coefficients the filter will include and the more precise it will be, but the more expensive its application will be in terms of calculation on decoding. This step therefore generates several filters of different sizes from which it will be necessary to choose the filter finally used. It will be seen that this choice step is performed by the module 309. As the coefficients of the ratio between the windows are real, and symmetrical in the space of the frequencies, the equivalent filter F is then, in the temporal domain, real and symmetrical. This property of symmetry can be used to transmit only half of the coefficients, the other being deduced by symmetry. Obtaining a symmetrical real filter also makes it possible to reduce the number of operations necessary during convolution of the extended received signal by the filter in the decoder. Other embodiments make it possible to obtain non-symmetrical real filters. For example, if the temporal signal in a working window is limited in frequency, it is possible advantageously to determine iteratively the parameters of a Chebyshev low-pass filter with infinite impulse response from spectra issuing from steps 304 and 306 and the cutoff frequency of the window.

In this way the filter is obtained, in the temporal space, supplied by the input of the choice module 309.

Optionally, a module 308 will offer other types of filter. For example, it may offer linear, cubic or other filters. These filters are known for allowing supersampling. To calculate the values of the samples added with an initial value at zero between the samples of the frequency-limited signal, it is possible to duplicate the value of the known sample, to take an average between the samples, which amounts to making a linear interpolation between the known values of the samples. All these types of filter are independent of the value of the signal and make it possible to re-shape the supersampled signal. The module 308 therefore contains an arbitrary number of such filters that can be used.

The choice module 309 will therefore have a collection of filters at the input. It will have the filters generated by the module 305 and corresponding to the filters generated for various sizes of window by division of the moduli of the Fourier transforms applied to the original signal and to the reconstructed signal. It will also have as an input the original signal 301 and the reconstructed signal issuing from the module 303. In this way, the module 309 can compare the application of the various filters to the reconstructed signal issuing from the module 303 with the original signal in order to choose the filter giving, on the signal portion in question, the best output signal, that is to say closest spectrally to the original signal. For example, it is possible to make the ratio between the spectrum obtained by application of the filter to the signal issuing from the module 303 and the spectrum of the same portion of the original signal. The filter generating the minimum of a function of the distortion is then chosen. This signal portion, called the working window, will have to be larger than the largest window that was used for calculating the filters; it will be possible to use typically a working window size of 512 samples. The size of this working window can also vary according to the signal. This is because a large size of working window can be used for the encoding of a substantially stationary part of the signal while a shorter window will be more suitable for a more dynamic signal portion in order to better take into account fast variations. It is this part that makes it possible to select, for each portion of the signal, the most relevant filter allowing the best reconstruction of the signal by the decoder and to get close to the original signal.

Once this filter is chosen, the module 310 will quantize the spectral coefficients of the filter that will be encoded, for example using a Huffman table for optimising the data to be transmitted. The multiplexer 314 will therefore multiplex, with each portion of the signal, the most relevant filter for the decoding of this signal portion. This filter, being chosen either in the collection of filters of different sizes generated by analysis of this signal portion, or in the collection, also comprises a series of given filters, typically linear, allowing the reconstruction, which can be chosen if they prove to be more advantageous for the reconstruction of the signal portion by the decoder. When the filter generated is one of the given filters, it is possible to transmit only an identifier identifying this filter among the collection of given filters, typically linear, allowing reconstruction, which can be chosen if they prove to be more advantageous for the reconstruction of the signal portion by the decoder. When the filter generated is one of the given filters, it is possible to transmit only an identifier identifying this filter among the collection of given filters supplied by the module 308, as well as any parameters of the filter. This is because, the coefficients of these given filters not being calculated according to the signal portion to which it is wished to apply them, it is unnecessary to transport these coefficients, which can be known to the decoder. Thus the bandwidth for transporting information relating to the filter is reduced in this case to a simple identifier of the filter.

Figure 4:
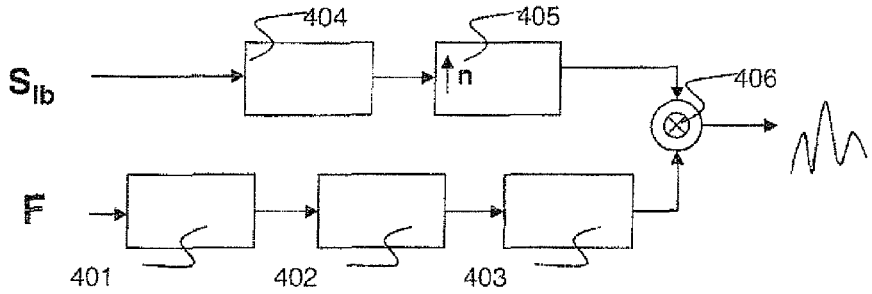
FIG. 4 shows the architecture of an embodiment of the decoder.

FIG. 4 shows the corresponding decoding in the particular embodiment described. The signal is received by the decoder, which demultiplexes the signal. The audio signal S1*b* is then decoded by the module 404 and then supersampled by a factor of n by the insertion of n−1 samples at zero between the samples received by the module 405. In parallel, the spectral coefficients of the filter F are dequantized and decoded in accordance with the Huffman tables by the module 401.

Advantageously, the size of the filter can be adapted by the module 402 of the decoder to its calculation or memory capacities or any possible hardware limitation. A decoder having few resources will be able to use a subsampled filter, which will enable it to reduce the operations when the filter is applied. The subsampled filter can also be generated by the encoder according to the resources of the transmission channel or the resources of the decoder, provided of course that the latter information is held by the encoder. In addition, the spectrum of the filter can be reduced on decoding in order to effect a lesser supersampling (n−1, n−2 etc) according to the sound rendition hardware capacities of the decoder such as the sound output power or capacities. The module 403 then effects an inverse Fourier transform on the spectral coefficients of the filter in order to obtain the real filter in the temporal domain. In the example embodiment, the filter is more symmetrical, which makes it possible to reduce the data transported for the transmission of the filter. The module 406 effects the convolution of the supersampled signal issuing from the module 405 with the filter thus constituted in order to obtain the resulting signal. This convolution is particularly economical in terms of calculation because the supersampling takes place by the insertion of nil values. Moreover, the fact that the filter is real, and even symmetrical in the preferred embodiment, also makes it possible to reduce the number of operations necessary for this convolution.

The filter being applied to the whole of the frequency-extended signal, the invention offers the advantage of effecting a reshaping not only of the high part of the spectrum reconstituted from the transmitted low part but the whole of the signal thus reconstituted. In this way, it makes it possible to model the part of the spectrum not transmitted but also to correct artefacts due to the various operations of compressing, decompressing, encoding and decoding the low-frequency part transmitted.

A secondary advantage of the invention is the possibility of dynamically adapting the filters used according to the nature of each signal portion by virtue of the module allowing choice of the best filter, in terms of quality of sound rendition and "machine time" used, among several for each portion of the signal.

The invention claimed is:

1. Method of encoding all or part of a signal, comprising:
- obtaining a signal;
- producing a frequency-limited signal from the obtained signal by suppression of high frequencies;
- producing a frequency-enhanced signal from the frequency-limited signal;
- generating characteristics information of at least one temporal filter that is capable of producing a signal spectrally close to the obtained signal when said temporal filter is applied to the frequency-enhanced signal, wherein Fourier transforms of different sizes are used for determining a plurality of corresponding temporal filters for providing a choice of filters for use, a particular filter for use from the plurality of generated temporal filters selected based upon a comparison of the obtained signal and a signal produced by applying each of the generated filters to the frequency-enhanced signal obtained by broadening the spectrum of the frequency-limited signal.

2. Method according to claim 1, wherein, for a portion of the obtained signal, a temporal filter is obtained based upon a member to member division of a function of coefficients of a Fourier transform that is applied to both the portion of the obtained signal and to a corresponding portion of the frequency-enhanced signal.

3. A method according to claim 1, wherein a collection of predetermined temporal filters is provided for enabling a choice of temporal filters to use.

4. Method according to claim 1, wherein, the frequency-limited signal being encoded for transmission thereof, the temporal filter is generated using a signal obtained by decoding and broadening a frequency spectrum of a locally generated encoded frequency limited signal and the obtained signal.

5. Method of decoding all or part of a received encoded signal, comprising:
- receiving a transmitted frequency-limited encoded signal;
- receiving temporal filter characteristics information corresponding to the received encoded signal, the temporal filter characteristics information based on a frequency-enhanced signal produced at a transmitter of the encoded signal;
- decoding the received encoded signal;
- producing an extended signal, restored in original spectral range, by broadening the frequency spectrum of a decoded signal; and
- producing a reconstructed signal by convolution of the extended signal with a generated temporal filter produced by using the temporal filter characteristics information received, wherein Fourier transforms of different sizes are used for determining a plurality of corresponding temporal filters for providing a choice of filters for use, a particular filter for use from the plurality of generated temporal filters selected based upon a comparison of the obtained signal and a signal produced by applying each of the generated filters to the frequency-enhanced signal obtained by broadening the spectrum of the frequency-limited signal.

6. A method according to claim 5, wherein a filter reduced in size from the generated temporal filter is used in place of the generated filter when producing a reconstructed signal.

7. A method according to claim 6, wherein the choice of using a temporal filter of reduced size in place of the temporal filter generated is made in accordance with existing predetermined capacities of the decoder.

8. A device for encoding a signal, comprising at least:
- frequency spectrum limiter which produces a frequency-limited signal by reduction of the frequency spectrum of an original signal to be encoded by suppression of the high frequencies,
- encoder for producing an encoded frequency-limited signal from the frequency-limited signal,
- temporal filter generator for generating a temporal filter for finding a signal close to the original signal when said temporal filter is applied to a restored signal, restored to original spectral range, by decoding and broadening of a frequency spectrum of the frequency-limited signal, wherein Fourier transforms of different sizes are used for determining a plurality of corresponding temporal filters for providing a choice of filters for use, a particular filter for use from the plurality of generated temporal filters selected based upon a comparison of the obtained signal and a signal produced by applying each of the generated filters to the frequency-enhanced signal obtained by broadening the spectrum of the frequency-limited signal.

9. A device for decoding a signal, comprising:
- receiver for receiving a transmitted frequency-limited version of a signal obtained at a transmitter,
- receiver for receiving temporal filter characteristics based on a pre-determined frequency-enhanced signal, said characteristics determined at a transmitter of the received signal, wherein Fourier transforms of different sizes are used for generating a plurality of temporal filters at the transmitter for providing a choice of filters for determining said filter characteristics, and wherein a particular filter from the plurality of temporal filters is chosen based upon a comparison at the transmitter of an obtained signal and a signal produced by applying each of the temporal filters to a frequency-enhanced signal produced by broadening the spectrum of the frequency-limited version of the obtained signal;

signal decoder for decoding a received encoded frequency-limited signal;

signal extender for obtaining a frequency extended signal, restored to original spectral range, by broadening a frequency spectrum of the decoded frequency-limited signal; and signal convolutor for producing a reconstructed signal by convolution of the frequency extended signal with received temporal filter characteristics.

10. Method of encoding all or part of a signal, comprising:

obtaining a signal;

producing a frequency-limited signal from the obtained signal by suppression of high frequencies;

producing a frequency-enhanced signal from the frequency-limited signal;

generating characteristics information of at least one temporal filter that is capable of producing a signal spectrally close to the obtained signal when said temporal filter is applied to the frequency-enhanced signal;

wherein, for a portion of the obtained signal, a temporal filter is obtained based upon a member to member division of a function of coefficients of a Fourier transform that is applied to both the portion of the obtained signal and to a corresponding portion of the frequency-enhanced signal, and wherein Fourier transforms of different sizes are used for determining a plurality of corresponding temporal filters for providing a choice of filters for use, a particular filter for use from the plurality of generated temporal filters is selected based upon a comparison of the obtained signal and a signal produced by applying each of the generated filters to the frequency-enhanced signal obtained by broadening the spectrum of the frequency-limited signal.

* * * * *